US007589477B2

(12) United States Patent
Chen et al.

(10) Patent No.: US 7,589,477 B2
(45) Date of Patent: Sep. 15, 2009

(54) CONTROL METHOD AND BALLAST FOR RUN-UP OF METAL HALIDE LAMP

(75) Inventors: Nancy H. Chen, North Andover, MA (US); Joseph A. Olsen, Gloucester, MA (US)

(73) Assignee: OSRAM Sylvania Inc., Danvers, MA (US)

( * ) Notice: Subject to any disclaimer, the term of this patent is extended or adjusted under 35 U.S.C. 154(b) by 19 days.

(21) Appl. No.: 11/860,759

(22) Filed: Sep. 25, 2007

(65) Prior Publication Data

US 2009/0079365 A1 Mar. 26, 2009

(51) Int. Cl.
*H05B 37/00* (2006.01)

(52) U.S. Cl. ..... 315/247; 315/224; 315/308

(58) Field of Classification Search ..... 315/247, 315/246, 248, 224, 307, 308, DIG. 5, DIG. 2
See application file for complete search history.

(56) References Cited

U.S. PATENT DOCUMENTS

| | | | | |
|---|---|---|---|---|
| 5,212,428 | A | 5/1993 | Sasaki et al. | |
| 5,448,139 | A | 9/1995 | Luursema et al. | |
| 5,481,163 | A | 1/1996 | Nakamura et al. | |
| 5,523,656 | A | 6/1996 | Luursema | |
| 5,684,367 | A | 11/1997 | Moskowitz et al. | |
| 6,124,683 | A | 9/2000 | Olsen et al. | |
| 6,208,088 | B1 | 3/2001 | Konishi et al. | |
| 6,229,269 | B1 | 5/2001 | Olsen | |
| 7,391,165 | B2 * | 6/2008 | Lee et al. | 315/247 |
| 2005/0029964 | A1 | 2/2005 | Ishibashi et al. | |
| 2007/0001624 | A1 * | 1/2007 | Blondia | 315/291 |

FOREIGN PATENT DOCUMENTS

| | | | |
|---|---|---|---|
| DE | 4132299 | A1 | 4/1992 |
| DE | 4428850 | A1 | 2/1995 |
| EP | 0483082 | A | 4/1992 |
| EP | 0896500 | A | 2/1999 |
| FR | 2857214 | A | 5/2009 |

OTHER PUBLICATIONS

U.S. Appl. No. 11/860,834, filed Sep. 25, 2007.

* cited by examiner

*Primary Examiner*—David Hung Vu
(74) *Attorney, Agent, or Firm*—Robert F. Clark

(57) ABSTRACT

A method of controlling run-up of a metal halide lamp that has a nominal (full) light output during steady state operation and that has a current limit $I_{lim}$, includes a lamp ballast sensing lamp current and voltage and calculating power, and evaluating requested power $P_{req}$ and requested current $I_{req}$ to operate the lamp at the nominal light output during run-up to steady state operation, supplying $I_{lim}$ to operate the lamp when $I_{req} \geqq I_{lim}$, and supplying $P_{req}$ to operate the lamp when $I_{req} < I_{lim}$. The method may determine $P_{req}$ in various ways, including determining a light output L of the lamp; comparing lamp voltage to a nominal voltage $V_n$ for the lamp during steady state operation; determining energy E delivered to the lamp; and estimating lamp efficacy. The method may also be used to characterize an unknown lamp attached to the ballast.

13 Claims, 4 Drawing Sheets

CONTROL METHOD AND BALLAST FOR RUN-UP OF METAL HALIDE LAMP

BACKGROUND OF THE INVENTION

The present invention is related to the invention described in copending application Ser. No. 11/860,834, filed concurrently herewith and titled FAST RUN-UP OF METAL HALIDE LAMP BY POWER MODULATION AT ACOUSTIC RESONANCE FREQUENCY which is incorporated herein by reference.

The present invention is directed to a method of decreasing the time from ignition to nominal (full) light output of a metal halide lamp.

Metal halide lamps for general lighting are efficient and produce high quality white light. However, the lamps require a few minutes to warm up to nominal light output because ballast output is focused mainly on steady-state operation. Shorter times to nominal light output would improve the applicability of metal halide lamps.

A faster run-up to steady state lamp operation can be achieved by overpowering a cold lamp. A temporarily high power level is not necessarily a problem, but because a cold lamp also tends to have a very low voltage, an excessively high current would be required to achieve the power needed (power=voltage×current). Moreover, care must be taken because excessive power or current can lead to thermal shock, electrode damage, and wall blackening, and lamps typically have a current limit during run-up to avoid these problems. Thus, light output does not reach nominal as quickly as desired.

SUMMARY OF THE INVENTION

An object of the present invention is to provide a novel method and ballast that shortens the time to nominal light output without damaging the lamp.

A yet further object of the present invention is to provide a novel method of controlling run-up of a metal halide lamp that has a nominal light output during steady state operation and that has a current limit $I_{lim}$, where the method includes sensing lamp current and voltage and calculating power, and evaluating requested power $P_{req}$ and requested current $I_{req}$ to operate the lamp at or near the nominal light output during the run-up to steady state operation, supplying $I_{lim}$ to operate the lamp when $I_{req}$ is greater than or equal to $I_{lim}$, and supplying $P_{req}$ to operate the lamp when $I_{req}$ is less than $I_{lim}$.

Another object of the present invention is to provide a novel ballast that carries out this method.

Yet another object of the present invention is to provide alternatives for determining when to switch from specifying lamp current to specifying lamp power, and how to adjust the power to maintain the nominal light output.

Still another object of the present invention is to use the method to characterize an unknown lamp attached to the ballast.

These and other objects and advantages of the invention will be apparent to those of skill in the art of the present invention after consideration of the following drawings and description of preferred embodiments.

DESCRIPTION OF PREFERRED EMBODIMENTS

Figure 1:
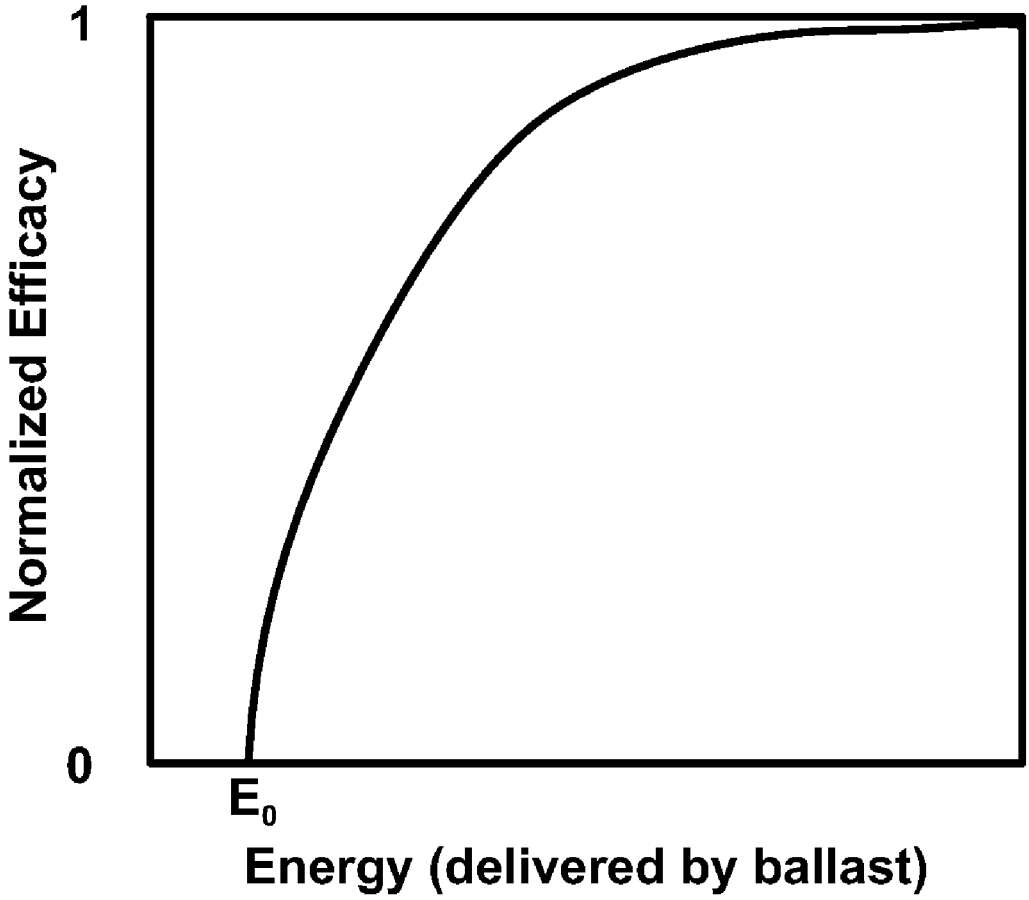
FIG. 1 is a graph of normalized lamp efficacy vs. energy delivered to the lamp.

To achieve the objectives set forth above, the inventors have focused on lamp control immediately following ignition, wherein lamp operation starts with lamp current at the current limit for the lamp. As energy is deposited to the arc and the arc tube heats up, the voltage, power and efficacy gradually increase until the nominal light output is achieved with the current at the current limit. At this point, the lamp is moderately overpowered since it has not warmed to its operating temperature. As the lamp warms, efficacy increases to the steady state level and the power is correspondingly decreased to maintain a (nearly) constant nominal light output. Decreasing the power as the lamp warms following the time at the current limit allows the lamp to be at or near nominal light output during the latter part of the run-up to steady state, and thus provides near nominal light output sooner than conventional metal halide lamps, thereby improving their applicability.

More particularly, the method of controlling run-up of a metal halide lamp that has a nominal light output $L_n$ during steady state operation and that has a current limit $I_{lim}$, includes the steps in which, during run-up of the metal halide lamp to steady state operation, lamp current I, voltage V, and power P are continuously sensed or calculated, and requested power $P_{req}$ and requested current $I_{req}$ for operating the lamp at the nominal light output $L_n$ during the run-up are continuously evaluated. The current limit $I_{lim}$ is supplied to the lamp so long as $I_{req}$ is greater than or equal to $I_{lim}$ and $P_{req}$ is supplied to the lamp when $I_{req}$ is less than $I_{lim}$. Supplying $P_{req}$ during the latter part of the run-up (when $I_{req}$ is less than $I_{lim}$) allows the lamp to be at or near nominal light output sooner than conventional metal halide lamps. The reference to "continuous" herein includes both analog signals and digital sampling.

The method may be carried out by a program embodied in a ballast, such as a conventional electronic ballast.

The method includes four alternatives for determining when to switch from specifying lamp current to specifying lamp power, and how to adjust the power to maintain the nominal light output.

The first alternative provides that, during the run-up to steady state, a light output L of the lamp is continuously determined, where $P_{req}$ is a function of L. More specifically, the method may provide that $$P_{req}=P*L_n/L, \text{ and}$$

$$I_{req}=I*P_{req}/P.$$

A photodiode may be used to measure L and appropriate conventional components may be provided so that the signal level is proportional to the lumen output of the lamp. Lamp power is scaled proportionally to $L_n$ (steady state) divided by L to provide $P_{req}$. Lamp current is scaled proportionally to $P_{req}$ divided by P to provide $I_{req}$.

This alternative decreases the time to nominal light output, although it may be less suitable than the alternatives discussed below in the event additional hardware (e.g., the photodiode) is cumbersome or dust may degrade signal reliability. In the other alternatives, feedback based on electrical parameters (voltage, energy delivered to the lamp, or lamp efficacy) is used.

The second alternative includes determining a nominal voltage $V_n$ for the lamp during steady state operation, where $P_{req}$ is a function of V and $V_n$. More specifically, the method may include determining a control coefficient C and a nominal power $P_n$ for the lamp during steady state operation, wherein $$P_{req}=P_n*(1+C*(V_n-V)/V_n), \text{ and}$$

$$I_{req}=I*P_{req}/P.$$

Voltage is an indicator of the lamp state, as cold lamps generally have a low voltage. Knowing the steady state lamp voltage, determining voltage during run-up and determining C by experimentation (e.g., on a similar lamp), permits formulation of power control algorithms based on voltage, of which the equation above is an example. The requested power is estimated by multiplying the nominal power by a factor that is dependent on the fractional deviation from nominal voltage and the control coefficient.

The second alternative also decreases the time to nominal light output, but may be less suited than the subsequent alternatives because as lamps age and among similar lamps the nominal voltage may vary, perhaps requiring some adjustment of the control parameters $V_n$ and C. Voltage scatter among lamps and voltage drift may be caused by chemical fill variations, which may be the result of inconsistent doping, impurities, and aging reactions.

The last two alternatives are more robust than the third alternative because they are based on energy and power which are based on thermal properties of the lamp that tend to be more constant than lamp voltage.

The third alternative is based on energy delivered to the lamp and includes determining warm-up energy $E_w$ delivered to the lamp when the lamp reaches nominal light output, and determining, during the run-up to steady state, energy E delivered to the lamp, where $P_{req}$ is a function of E and $E_w$. More specifically, the method includes determining a power decay coefficient $\tau$ for the lamp, and, during run-up to steady state, $$\text{if } E<E_w, \text{ then } I_{req}=I_{lim}, \text{ and}$$

$$\text{if } E\geqq E_w, \text{ then } P_{req}=P_n+(P-P_n)*\exp(-\Delta t/\tau) \text{ and}$$
$$I_{req}=I*P_{req}/P,$$

wherein $\Delta t$ is the time elapsed per feedback loop control.

The third alternative runs the lamp at the current limit until a specified amount of energy is delivered by the ballast, with the lamp being sufficiently warmed to reach nominal light output when the specified amount of energy has been delivered. As the lamp warms further, efficacy increases and power is decreased to the steady state level. An exponential reduction of the power with time has been found to work reasonably well producing a level nominal light output while the power is reduced. Thus, the control parameters are warm-up energy and the power decay coefficient.

In the third alternative warm-up energy $E_w$ decreases with allowed run-up current (the limit current $I_{lim}$), since a higher run-up current means higher power levels during run-up which means lower efficacies and less lamp heating are required to reach nominal light output. Higher run-up currents and correspondingly higher power input also require faster power decay coefficients in order to produce the desired light output. Thus, the third alternative is reasonably stable against voltage variation, although the control parameters should be adjusted for different run-up currents. Nevertheless, for a given lamp with a specified current limit, the proper coefficients can be determined to provide consistent light output during run-up.

The fourth alternative includes approximation of the normalized lamp efficacy as a function of energy delivered to the ballast. The normalized lamp efficacy is assumed to range from approximately zero to one at steady state operation. It has been observed that for a number of lamps the normalized efficacy (ignoring dependence on instantaneous power) versus ballast energy can be approximated as an exponential, characterized by a coefficient $E_1$ and perhaps with an offset $E_0$. This is shown in FIG. 1.

That is, the fourth alternative includes determining a function of normalized lamp efficacy $\eta$ vs. energy E delivered to the lamp, and, during the run-up to steady state, determining E and estimating $\eta$ from the function, wherein $$P_{req}=P_n/\eta, \text{ and}$$

$$I_{req}=I*P_{req}/P.$$

The function by which lamp efficacy $\eta$ is estimated may be $$\text{for } E\geqq E_0, \eta=1-\exp(-(E-E_0)/E_1), \text{ and}$$

$$\text{for } E<E_0, \eta=0,$$

where $E_0$ and $E_1$ are constants which describe $\eta(E)$. The function may be stored in a table in a memory in the ballast.

If $E_0$ and $E_1$ are specified, then the normalized lamp efficacy can be approximated at times during the run-up, and the requested power $P_{req}$ is the nominal power divided by the normalized lamp efficacy.

For example, if at some point during the run-up the normalized lamp efficacy is 0.5, then the lamp power should be twice the nominal level. Of course, at the beginning of the run-up the current limit may control so the lamp power may not be attainable.

One advantage of the fourth alternative over the previous alternatives is that for a given lamp design, a single set of parameters $E_0$ and $E_1$ can generally be found to give reasonable run-up results independent of the current limit. The better the approximation of normalized efficacy, the more "ideal" the light output versus time (less deviation from $L_n$). Errors in approximation at the beginning of the run-up are less significant because the requested power will likely be limited by the current limit.

Figure 3:
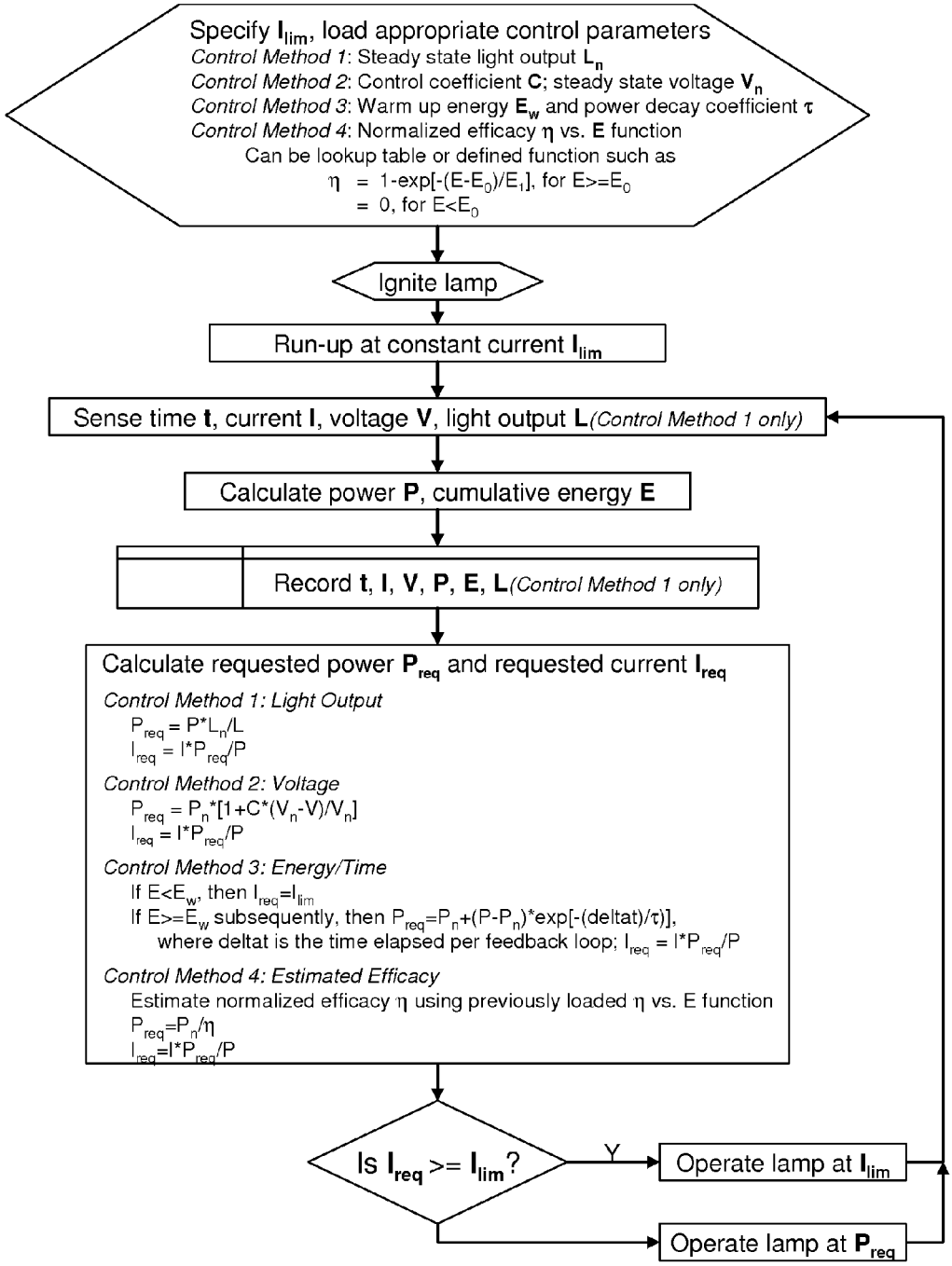
FIG. 3 is a flow chart summarizing the four alternatives for controlling lamp run-up.

The four alternatives are summarized in the flowchart of FIG. 3.

One of the byproducts of the method of the present invention is that it can be used in a "smart" ballast to determine the characteristics of an unknown lamp to which the ballast is attached. That is, the method can be used in a standard ballast that is usable with various lamps, with the ballast itself figuring out how to apply current and power to reduce the time to nominal light output.

Figure 2:
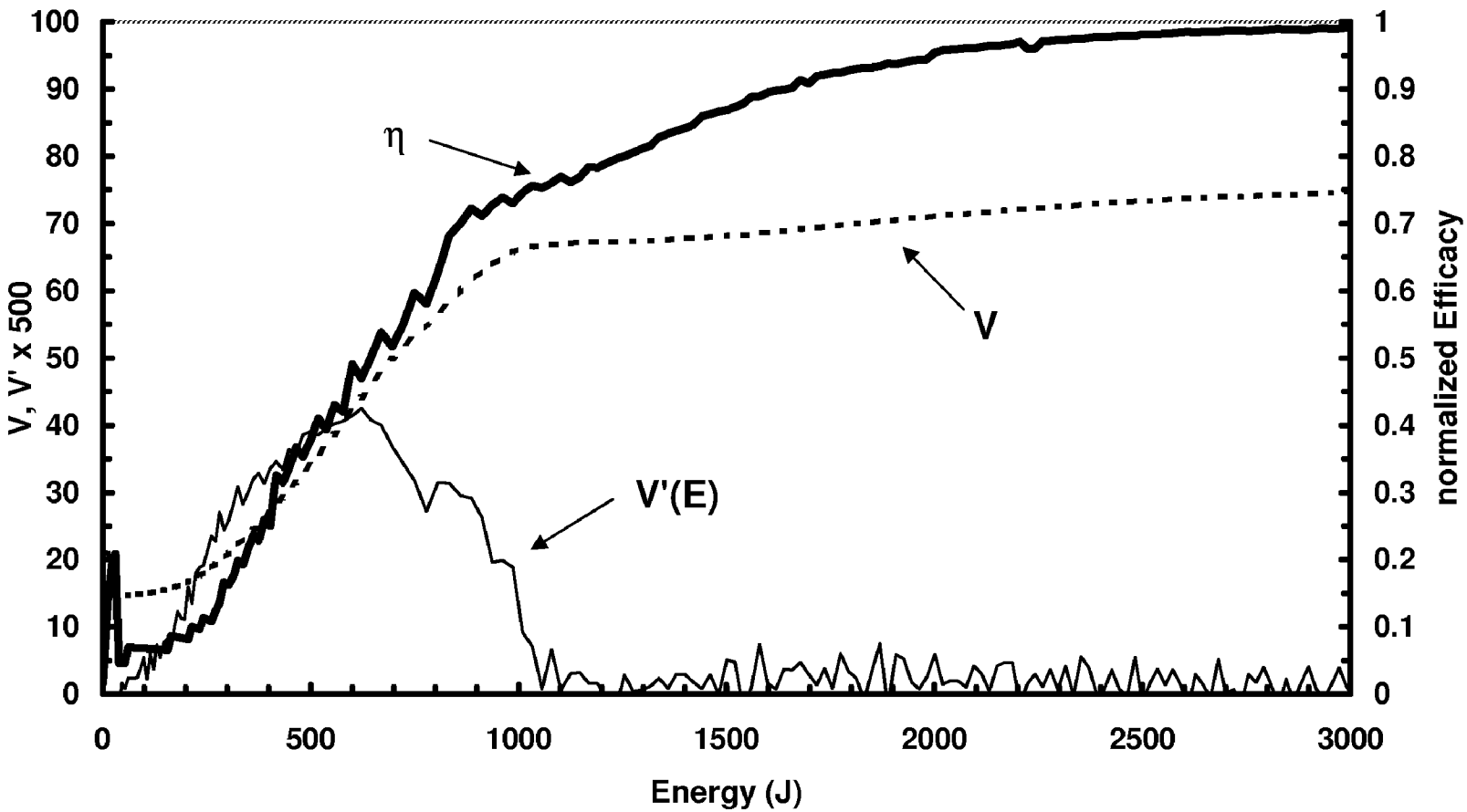
FIG. 2 is a graph of V, V'(E) and normalized lamp efficacy η vs. energy showing the derivative peak at about η=0.4.

It has been observed that the derivative of voltage with respect to energy (V'(E)) delivered to the lamp reaches a peak during the run-up, with the corresponding normalized lamp efficacy at this time being about 0.3 to 0.5. FIG. 2 is a graph of V, V'(E) and normalized lamp efficacy $\eta$ vs. energy showing the derivative peak at about $\eta$=0.4.

The peak in V'(E) is likely related to the evaporation process of the mercury dose, but an exact explanation is not needed in order to apply the results. For now, it is assumed that when V'(E) reaches a peak, the normalized lamp efficacy $\eta$ is 0.4. Experimental determination of the energy at which V'(E) reaches its peak can be used to fit the equation given above and repeated below $$\eta=1-\exp(-(E-E_0)/E_1).$$

From this, a value of $E_1$ can be estimated if a value of $E_0$ is assumed. Since $E_1$ represents a thermal characteristic of the lamp and is generally higher for higher wattage lamps, the estimate of $E_1$ can be used to estimate the rated wattage. In other words, a ballast can be programmed to determine $E_1$ and then identify the lamp. Once the lamp is known, the correct nominal steady state power is known and the run-up light output versus time can be controlled as explained above.

When an unknown lamp is attached to the ballast, care must be taken to avoid excessive current, as discussed in the beginning of this document. One could use low starting currents, but this would increase the time to nominal light output. Currents that are too low can also cause excessive wall blackening due to electrode sputtering. This problem can be addressed by controlling the current so that the initial current is low enough for a range of lamp types, say about 0.5 A so that electrodes as small as 20 W would not be damaged. Thereafter, if the maximum V'(E) is not detected after a certain amount of energy is delivered, thereby indicating that $E_1$ is larger than for a 20 W lamp, then the current limit could be increased to a level suitable for a next larger lamp, say to about 1.0 A for a 35 W lamp. As subsequent $E_1$ thresholds are passed, the run-up current could be increased incrementally until the rate lamp power is finally identified. Alternatively, a controlled ramping up of the current may be used instead of the incremental steps just mentioned.

Figure 4:
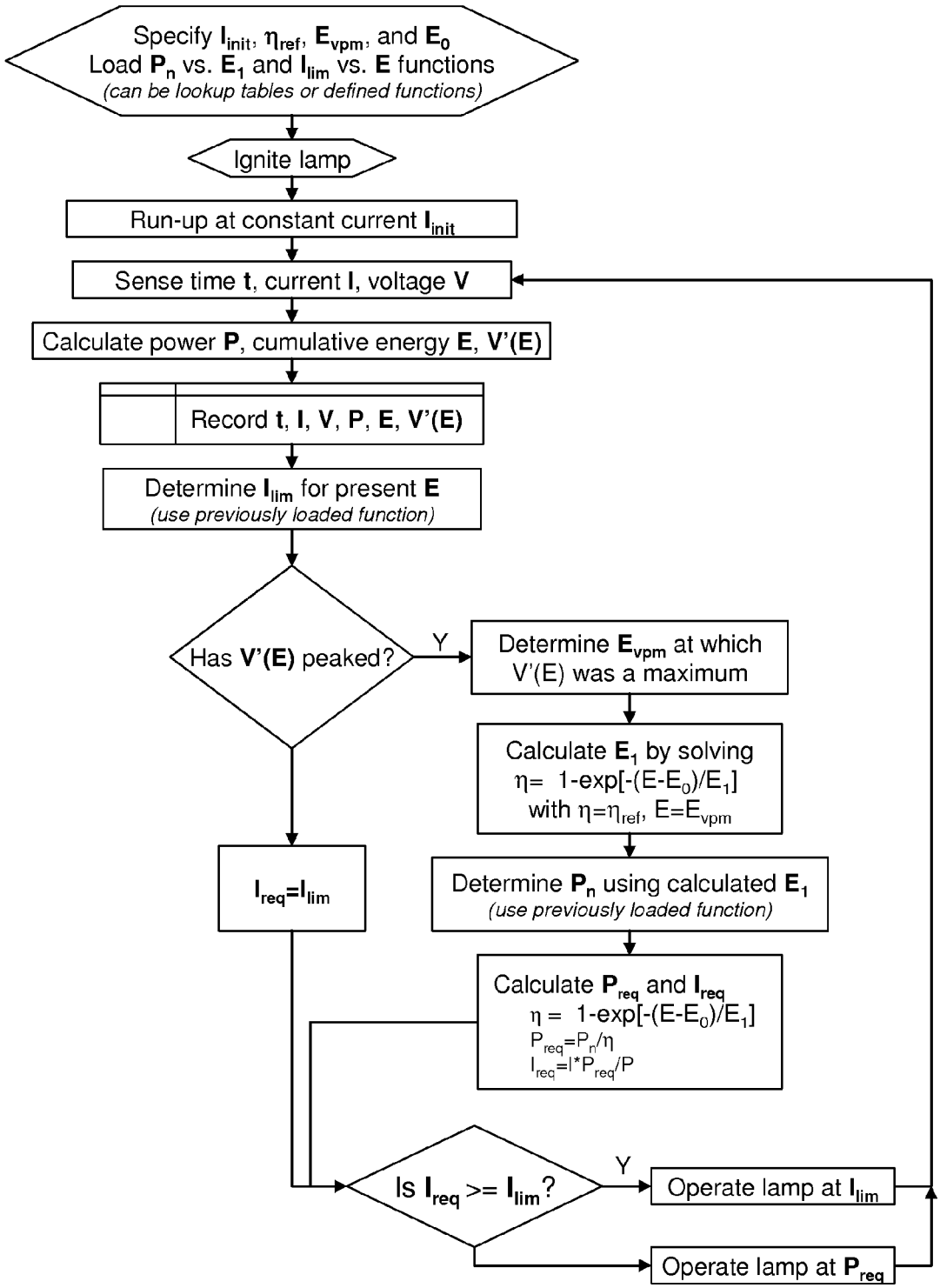
FIG. 4 is a flow chart showing a process for determining characteristics of an unknown lamp.

This embodiment is summarized in the flowchart of FIG. 4.

While embodiments of the present invention have been described in the foregoing specification and drawings, it is to be understood that the present invention is defined by the following claims when read in light of the specification and drawings.

We claim:

1. A method of controlling run-up of a metal halide lamp that has a nominal light output $L_n$ during steady state operation and that has a current limit $I_{lim}$, the method comprising the steps of:

during run-up of the metal halide lamp to steady state operation, continuously sensing lamp current I and voltage V and calculating power P, and continuously evaluating requested power $P_{req}$ and requested current $I_{req}$ to operate the lamp at the nominal light output $L_n$ during the run-up;

supplying $I_{lim}$ to operate the lamp so long as $I_{req} \geqq I_{lim}$; and supplying $P_{req}$ to operate the lamp when $I_{req} < I_{lim}$.

2. The method of claim 1, further comprising the step of, during the run-up, continuously determining a light output L of the lamp, and wherein $P_{req}$ is a function of L.

3. The method of claim 2, wherein $$P_{req}=P*L_n/L, \text{ and}$$

$$I_{req}=I*P_{req}/P.$$

4. The method of claim 1, further comprising the step of determining a nominal voltage $V_n$ for the lamp during steady state operation, and wherein $P_{req}$ is a function of V and $V_n$.

5. The method of claim 4, further comprising the step of determining a control coefficient C and a nominal power $P_n$ for the lamp during steady state operation, and wherein $$P_{req}=P_n*(1+C*(V_n-V)/V_n), \text{ and}$$

$$I_{req}=I*P_{req}/P.$$

6. The method of claim 1, further comprising the steps of determining warm-up energy $E_w$ delivered to the lamp when the lamp reaches the nominal light output, and determining, during the run-up, energy E delivered to the lamp, and wherein $P_{req}$ is a function of E and $E_w$.

7. The method of claim 6, further comprising the steps of determining a power decay coefficient τ for the lamp, and, during the run-up, $$\text{if } E<E_w, \text{ then } I_{req}=I_{lim}, \text{ and}$$

$$\text{if } E \geqq E_w, \text{ then } P_{req}=P_n+(P-P_n)*\exp(-\Delta t/\tau), \text{ and}$$
$$I_{req}=I*P_{req}/P$$

wherein Δt is the time elapsed per feedback loop control.

8. The method of claim 1, further comprising the step of, during the run-up, estimating lamp efficacy, and wherein $P_{req}$ is a function of lamp efficacy.

9. The method of claim 1, further comprising the steps of determining a function of normalized lamp efficacy η vs. energy E delivered to the lamp, and, during the run-up, determining E and estimating η from the function, and wherein $$P_{req}=P_n/\eta, \text{ and}$$

$$I_{req}=I*P_{req}/P.$$

10. The method of claim 9, wherein the function is stored in a table in a memory in a ballast that operates the lamp.

11. The method of claim 9, wherein the function is $$\text{for } E \geqq E_0, \eta=1-\exp(-(E-E_0)/E_1), \text{ and}$$

$$\text{for } E<E_0, \eta=0,$$

where $E_0$ and $E_1$ are constants which describe η(E).

12. The method of claim 1, further comprising the steps of, determining values for normalized lamp efficacy η and energy E delivered to the lamp when a derivative of lamp voltage V'(E) is at a peak during the run-up, assigning a value for $E_0$, determining a value of $E_1$ from $\eta=1-\exp(-(E-E_0)/E_1)$, estimating characteristics of the lamp from the determined value of $E_1$.

13. A ballast for a metal halide lamp that has a nominal light output $L_n$ during steady state operation and that has a current limit $I_{lim}$, said ballast embodying a program that causes the ballast to control run-up of the metal halide lamp to steady state operation, the program causing the ballast to perform the steps of:

during run-up of the metal halide lamp to steady state operation, continuously sensing lamp current I and voltage V and calculating power P, and continuously evaluating requested power $P_{req}$ and requested current $I_{req}$ to operate the lamp at the nominal light output $L_n$ during the run-up;

supplying $I_{lim}$ to operate the lamp so long as $I_{req} \geqq I_{lim}$; and supplying $P_{req}$ to operate the lamp when $I_{req} < I_{lim}$.

* * * * *